US005228807A

United States Patent [19]

Willcox, Jr. deceased

[11] Patent Number: 5,228,807

[45] Date of Patent: Jul. 20, 1993

[54] FOUNDATION SUPPORT APPARATUS WITH SECTIONAL SLEEVE

[75] Inventor: Frederick E. Willcox, Jr. deceased, late of Houston, Tex., by Rita E. Willcox, executrix

[73] Assignee: Perma Pile Foundation Restoration Systems, Inc., Houston, Tex.

[21] Appl. No.: 747,524

[22] Filed: Aug. 20, 1991

[51] Int. Cl.[5] ..... E02D 5/60; E02D 7/02

[52] U.S. Cl. ..... 405/232; 405/252; 405/255; 405/257

[58] Field of Search ..... 405/216, 229, 231, 232, 405/251, 252, 255, 256, 257

[56] References Cited

U.S. PATENT DOCUMENTS

| | | | |
|---|---|---|---|
| 1,181,876 | 5/1916 | Hall | 405/255 X |
| 1,954,070 | 4/1934 | Cook | 405/257 X |
| 2,181,526 | 11/1939 | Upton | 405/216 |
| 2,645,090 | 7/1953 | Kinneman et al. | 405/232 |
| 2,983,104 | 5/1961 | Bruns . | |
| 3,487,646 | 1/1970 | Gatien | 405/257 |
| 3,555,833 | 1/1971 | Correa | 405/232 |
| 4,537,534 | 8/1985 | Marsh . | |
| 4,721,418 | 1/1988 | Queen | 405/231 |

FOREIGN PATENT DOCUMENTS 2092212 8/1982 United Kingdom .

*Primary Examiner*—David H. Corbin

*Attorney, Agent, or Firm*—Vaden, Eickenroht, Thompson, Boulware & Feather

[57] ABSTRACT

A foundation support apparatus having at least one concrete piling having a plurality of vertical piling sections surrounded by a sleeve having a plurality of vertical sleeve sections is provided. The vertical piling sections extend from the foundation to below the subsurface water table. The sleeve sections form a continuous sleeve capable of protecting the piling from uplifting soil pressure occurring in the zone of moisture change.

3 Claims, 1 Drawing Sheet

FIG. 1
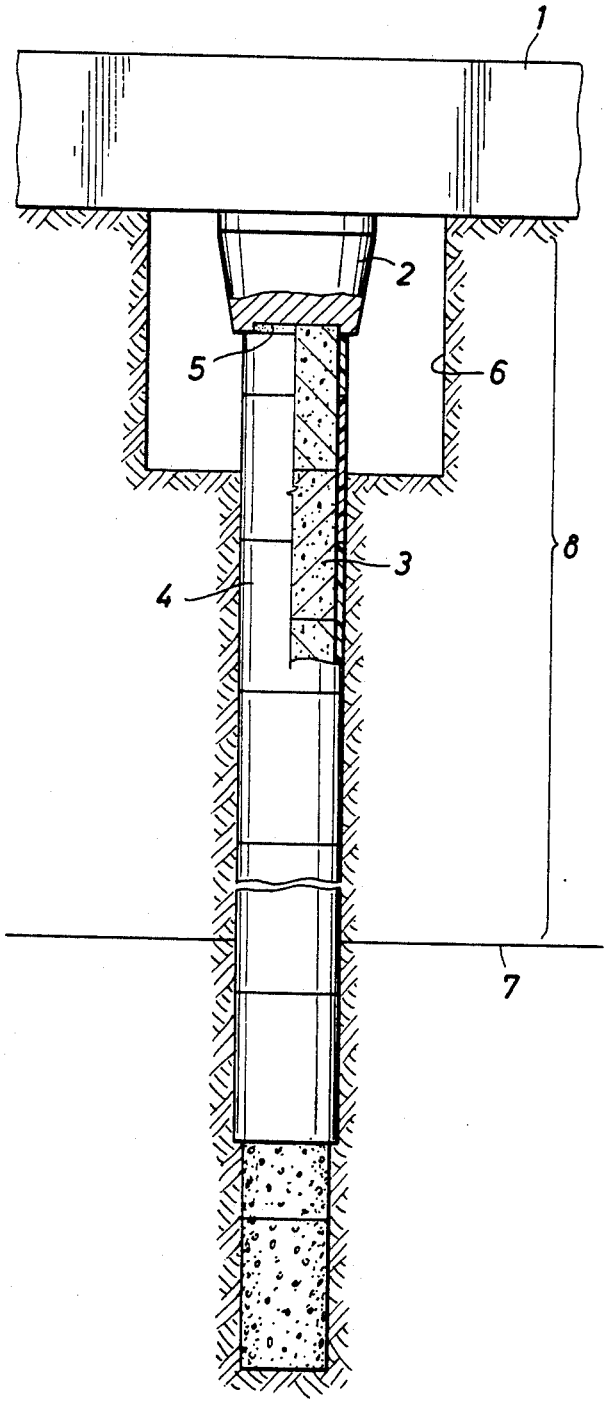
FIG. 2
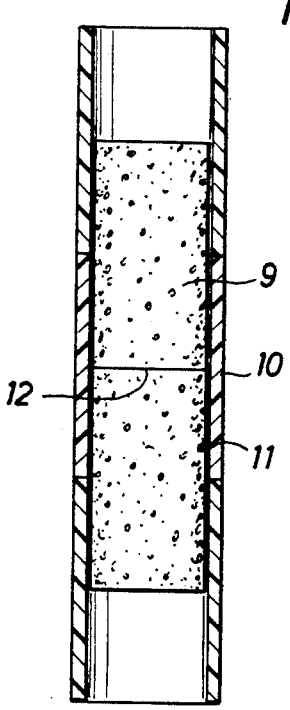
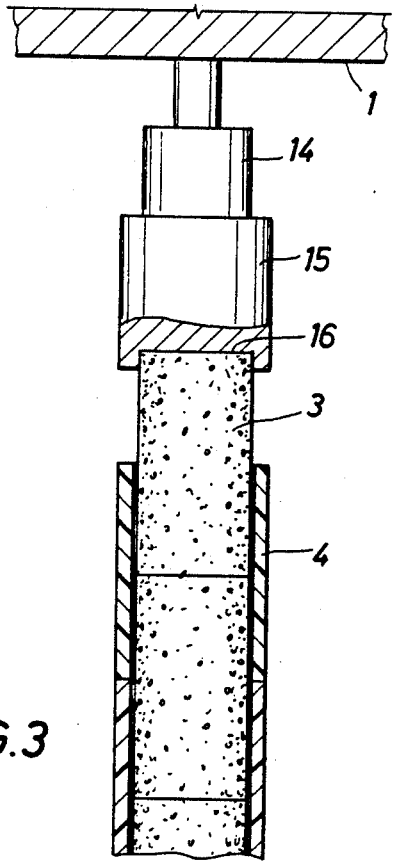
FIG. 3

FOUNDATION SUPPORT APPARATUS WITH SECTIONAL SLEEVE

FIELD OF THE INVENTION

This invention relates to the field of foundation supports for buildings and other structures. More particularly, this invention relates to a foundation support apparatus comprising a sectional sleeve surrounding a construction piling. Sectional sleeve segments are driven simultaneously with construction piling segments in order to prevent uplifting pressure from acting on a piling.

DESCRIPTION OF THE PRIOR ART

Many buildings and other types of structures have been built on foundations or slabs made of concrete poured on top of soil. Constant changes in the weather and moisture levels in the soil frequently cause damage to such a foundation. In many instances, the foundation may buckle or even crack. This phenomenon occurs because prior to placing the foundation on the ground, the moisture beneath it is constant. Placing a foundation on the soil distorts the evaporation of the moisture underneath the foundation, thereby causing water build-up and relative soil swelling in the middle of the structure. Eventually, an uplifting can occur in the center because the moisture from around the edges relative to the center is drawn away by evaporation and/or by wicking action of the adjacent shrubbery or plant life. Over a period of time, the foundation can "dome", causing damage or failure.

There are several methods used in repairing foundations. One of the most effective and widely used methods includes the use of one or more piles submerged into the soil beneath the foundation to form one or more supports. Most of the supports are made primarily of concrete and have an overall cylindrical shape with a length varying according to the soil type and weight of the structure. For clarity, the words "pile" and "piling" are synonymous terms signifying a single structure, and the word "piles" and "pilings" are synonymous terms signifying a plural structure of more than one pile.

One of the most successful foundation rehabilitation procedures involves excavating, or partially excavating, underneath the grade beams that need to be supported or raised, placing a concrete piling section in the excavated cavity underneath the grade beam, placing a construction jack between the grade beam and the piling section, and then operating the jack by hydraulic or pneumatic action to force the piling section downward into the ground while supporting the grade beam. Once the piling section is driven sufficiently into the ground so that its top is flush with the bottom of the excavated area, another piling section is put in place on top of the previous piling section and the jack is reactivated. Eventually, either the piling made up of the piling sections will hit bedrock or the ground underneath and surrounding the piling will become so compacted as to make further piling section additions unnecessary.

When pilings are driven through soils subject to moisture change, uplift on the piling system may occur at the zone of moisture change. The uplifting pressure exerted on the piling system by the surrounding soil may disrupt the alignment and integrity of the piling. The uplifting pressure exerted by the soil at the zone of moisture change may necessitate that the piling system be insulated from the zone of moisture change to prevent damage to piling systems. No means currently exists by which to easily and economically protect a piling from the uplifting forces.

It is a feature of this invention to provide an improved foundation support apparatus that is a concrete piling having a plurality of successive vertical sections placed end-to-end extending from the foundation to below the subsurface water table, with each piling surrounded by a plurality of successive vertical sleeve sections placed end-to-end so that the ends of the sleeve sections are staggered with respect to the ends of the concrete piling sections.

It is also a feature of this invention to provide an improved foundation support apparatus which will protect concrete pilings from uplifting soils. The uplifting soils will ride up on the sleeves surrounding the pilings without bringing the uplifting pressure on the surrounded piling.

It is still a further feature of this invention to provide an improved method of installing a foundation support apparatus consisting of the described vertical concrete piling sections surrounded by vertical sleeve sections.

SUMMARY OF THE INVENTION

The present invention was designed to reduce the destructive effects of uplifting soil pressure on a piling. The inventive structure is a foundation support apparatus comprised of at least one concrete piling having a plurality of successive vertical sections placed end-to-end. The piling sections extend from the foundation to below the subsurface of the water table. A sleeve, having a plurality of successive vertical sections, surrounds each piling. The sleeve sections are placed end-to-end so that the ends of the sleeve sections are staggered with respect to the ends of the concrete piling sections. The piling sections and the sleeve sections are of substantially equal length. The individual sleeve sections form a continuous sleeve for the concrete piling system. The individual sleeve sections may be glued end-to-end if desired. Any uplifting soils surrounding the foundation apparatus will ride up on the sleeve without bringing uplifting pressure on the surrounded pilings.

The foundation support apparatus includes a driving head with a bottom recess for snugly accommodating over the outside of the top of each concrete piling section. The sleeve sections abut the driving head at a location external of the bottom recess. A driving head is placed over the first vertical piling section and the piling section is vertically driven into the soil. A vertical sleeve section is then placed over the first piling section. The sleeve section has an external peripheral dimension which is larger than the inside annulus dimension of the driving head recess. The lower end of the first sleeve section will be above the lower end of the first piling section.

Subsequent piling sections are added by placing a piling section into the first sleeve section to abut end-to-end the first piling section. The driving head bottom recess is placed over the second vertical piling section which is driven vertically, driving both the second and first piling sections into the soil along with the first vertical sleeve section. Successive vertical sleeve sections and piling sections are driven until at least the first piling section, the lower end of the second piling section and the lower end of the first sleeve section are beneath the water table. The ends of the sleeve sections will be staggered with respect to the ends of the piling sections.

BRIEF DESCRIPTION OF THE DRAWINGS

So that the manner of the above-recited features, advantages and objects of the invention, as well as others which will become apparent are attained and can be understood in detail, a more particular description of the invention briefly summarized above may be had by reference to the exemplary preferred embodiments thereof illustrated in the drawings that form part of this specification. It is nevertheless to be noted that the appended drawings illustrate only preferred embodiments of the invention and are not to be considered limiting of its scope as the invention may admit to other equally effective embodiments.

In the drawings:

FIG. 1 is a cut-away front view, in section, of a preferred embodiment of the present invention.

FIG. 2 shows, in a plan view, a piling section inside a sleeve section of the preferred embodiment.

FIG. 3 is a plan view of piling sections and sleeve sections as driven by a driving head to a point below the water table.

DESCRIPTION OF THE PREFERRED EMBODIMENT

As discussed above with regard to the prior art, the initial step of a typical foundation repair procedure which utilizes concrete piling sections involves excavating underneath the foundation to provide access to below a grade beam needing support. The depth of the access excavation shall be adequate to allow a section of piling, a section of sleeve for surrounding the piling section, and a retracted jack to be positioned under a grade beam of the foundation or slab, as shown in FIG. 3. Piling sections and sleeve sections are installed by the jacks using the weight of the structure to provide the driving load.

The preferred embodiment may be installed using either of, or a combination of, two excavation methods. A number of jacks may be placed in series in a single excavation known in the art as a tunnel, or individual jacks may be placed in separate excavations dug in various locations, generally 6 to 8 feet apart. The jacks engage the bottom of a grade beam that, in turn, supports at least a portion of the remainder of the foundation and the structure built thereon. Each jack is used in setting a separate piling with the surrounding sleeve in the manner described.

Now, referring to the drawings and first FIG. 1, a front view, in partial cutaway section, of a preferred embodiment of the invention is illustrated. An access excavation 6 allows access to beneath grade beam 1. Grade beam 1 is supported by the inventive structure foundation support apparatus comprised of concrete piling sections 3 and sleeve sections 4. The piling sections make up a piling system. The individual sleeve sections produce a continuous sleeve surrounding the concrete piling. The individual sleeve sections may be glued end-to-end if desired. A suitable pile cap 2 gradually distributes the downward force of the structure load onto the top of the uppermost piling section and the top sleeve section. In the preferred embodiment, pile cap 2 will have a bottom recess 5 of approximately 1 inch in depth. The shape of bottom recess 5, preferably concentric, corresponds with the shape of the top of the piling. The diameter of bottom recess 5 will be approximately 6 1/16 inches to accommodate the top of the average piling section. The dimensions of a piling section may vary, but generally is approximately 12 inches in height and 6 inches in diameter. Sleeve sections will be of similar length to that of the piling sections.

The piling surrounded by the sleeve sections passes through the zone of moisture change 8 to a point below the subsurface water table, as shown in FIG. 1. Without the protective sleeve surrounding the piling, the piling may be subjected to uplifting pressures produced by the soil in this area. The sleeve sections 4 which surround the concrete piling will insulate the piling from uplifting pressure which could damage the piling. The preferred embodiment will have at least the lowermost piling section at a location below the top of the subsurface water table 7.

FIG. 2 shows piling sections 9 within the sleeve sections 10. A plurality of successive vertical sleeve sections 10 placed end-to-end surround the concrete piling sections in such manner that the ends of the sleeve sections are staggered with the ends of the piling sections 12. The sleeve ends 11 may be glued one to the other using a PVC pipe glue or any such similar glue known in the industry; however, this is not necessary. The sleeve sections surrounding the piling form a single, continuous protective sleeve. Sleeve sections 10 have an inside annulus dimension which is greater than the external peripheral dimension of piling sections 9. In the preferred embodiment, sleeve sections 10 will be composed of a light-weight material, such as PVC pipe, having an inside annulus dimension of approximately 6¼ inches.

FIG. 3 illustrates the preferred embodiment during installation. A hydraulic jack 14 provides the driving force needed to drive piling sections and sleeve sections. Directly beneath and, in contact with jack 14, is located a driving head 15, as shown in FIG. 3.

A driving head 15 with a bottom recess 16 is used in vertically driving piling sections 3 and sleeve sections 4. Bottom recess 16 should be approximately 6 1/16 inch in diameter in order to snugly accommodate over the outside of the top of one of said concrete piling sections 3. The shape of the recess, preferably concentric, corresponds with the shape of the top of the piling. The driving head 15 with a bottom recess 16 will snugly accommodate the top of a piling section and will have the top of a sleeve section abutting the driving head at a location external of the bottom recess as shown in FIG. 3. Bottom recess 11 of the driving head also serves to provide resistance to any rotational moment produced during the vertical driving of the piling section.

The foundation piling 3 is installed by placing driving head 15 with bottom recess 16 over a first vertical piling section and vertically driving the first piling section into the soil. A first vertical sleeve section 4 is then placed over the first piling section 3, the lower end of the first sleeve section 4 being above the lower end of the first piling section. Subsequent piling sections 3 and sleeve sections 4 are vertically driven by placing a second vertical piling section into the first sleeve section to abut end-to-end the first piling section. The driving head 15 with bottom recess 16 is placed over the second vertical piling section and the second and first piling sections are driven vertically into the soil. Successive vertical piling sections and sleeve sections are added until at least the first piling section, the lower end of the second piling section, and the lower end of the first sleeve section are beneath the water table.

While a particular embodiment has been described and illustrated it will be understood that the invention is not limited thereto, since many modifications may be made and will become apparent to those skilled in the art.

What is claimed is:

1. The method of installing a foundation piling, which comprises (a) placing a driving head with a bottom recess over a first vertical piling section and vertically driving the first piling section into the soil, (b) placing a first vertical sleeve section over the first piling section, the external peripheral dimension thereof being larger than the inside annulus dimension of the driving head recess, the lower end of the first sleeve section being above the lower end of the first piling section, (c) placing a second vertical piling section into the first sleeve section to abut end-to-end the first piling section, (d) placing the driving head bottom recess over the second vertical piling section and vertically driving the second and first piling sections into the soil, (e) repeating steps (b) and (d) for successive vertical sleeve sections and piling sections until at least the first piling section, the lower end of the second piling section, and the lower end of the first sleeve section are beneath the water table, the ends of the sleeve sections being staggered with respect to the ends of the piling sections, and (f) positioning a pile cap with a bottom recess over the uppermost piling section surrounded by a sleeve section such that the pile cap is in contact with the supported structure and gradually distributes the weight of said structure onto the foundation support apparatus with the sectional sleeve.

2. The method of claim 1, wherein the sleeve sections are adhered end-to-end.

3. The method of claim 1, wherein the sleeve sections are glued end-to-end.

* * * * *